US005865516A

United States Patent [19]

Woy

[11] Patent Number: 5,865,516

[45] Date of Patent: Feb. 2, 1999

[54] MODEL DISPLAY CASE

[76] Inventor: Rodger O. Woy, 13110 Scott Rd., Waynesboro, Pa. 17268

[21] Appl. No.: 987,022

[22] Filed: Dec. 9, 1997

[51] Int. Cl.[6] ..... A47F 3/10

[52] U.S. Cl. ..... 312/125; 312/114; 40/431; 362/125

[58] Field of Search ..... 312/114, 117, 312/125, 128, 135, 284, 9.45, 9.46, 223.5; 40/431; 362/125

[56] References Cited

U.S. PATENT DOCUMENTS

| | | | |
|---|---|---|---|
| 845,652 | 2/1907 | Berge | 312/114 X |
| 1,261,812 | 4/1918 | Higgins | 312/114 X |
| 1,421,008 | 6/1922 | Inman . | |
| 1,525,330 | 2/1925 | Smith | 312/135 |
| 1,912,899 | 6/1933 | Johannsen | 312/114 |
| 2,000,537 | 5/1935 | Ransom | 312/125 X |
| 2,023,260 | 12/1935 | Beers et al. | 312/114 |
| 2,075,918 | 4/1937 | Waalkes | 108/20 X |
| 3,738,035 | 6/1973 | Bricker | 40/431 |
| 3,861,766 | 1/1975 | Corsini et al. | 312/125 |
| 4,821,158 | 4/1989 | Mitten . | |
| 5,125,726 | 6/1992 | Hahn et al. | 312/114 |

FOREIGN PATENT DOCUMENTS

| | | | |
|---|---|---|---|
| 2385366 | 12/1978 | France | 312/125 |
| 1154242 | 6/1969 | United Kingdom | 362/125 |

*Primary Examiner*—Peter M. Cuomo
*Assistant Examiner*—James O. Hansen
*Attorney, Agent, or Firm*—Dowell & Dowell, P.C.

[57] ABSTRACT

A model display case, which may be decorated to be simulative of a building, includes a base having a raised support surface providing a "floor" in which an electrically powered rotating turntable is centrally positioned. A clear cover is mounted over the base and includes a raised extension in which a plurality of lights are mounted to provide illumination of the case. The lights are screened from view from the outside of the case by reflectors extending from the extension and screen-covered vents are preferably provided to allow for dissipation of heat produced by the lights from the interior of the case to the outside environment.

12 Claims, 6 Drawing Sheets

MODEL DISPLAY CASE

BACKGROUND OF THE INVENTION

1. Field of the Invention

This invention is generally directed toward display cases, and more particularly, to an illuminated model display case which is decorated to be simulative of a building and which includes a rotating platform for rotating a displayed item.

2. History of the Related Art

The building of scale model automobiles and other items such as scale model airplanes and trains has become a very popular hobby for many individuals. Display cases are known for containing such models. An example of one known type of display case, which is marketed by AMT/Ertl Inc., is a plastic model car display case constructed of a rectangular plastic base with includes a box-like clear plastic lid. This known display does not provide any means for illuminating the displayed object other than by ambient light, nor is there provided any means to enable an observer to view all sides of the displayed object without having to walk around the case, which may be impractical when the case is displayed in a crowded room or near a wall.

In view of the limitations associated with the known devices for displaying items, particularly models, there has been a need for a new display case which includes means for illuminating the displayed item and which avoids the necessity of walking around the entire case to view all sides of the displayed item.

SUMMARY OF THE INVENTION

The present invention has been made in view of the above described and other limitations of known cases for displaying items such as scale models.

It is an object of the present invention to provide a model display case which is decorated to be outwardly simulative of a building such as a vintage automobile dealership.

It is yet another object of the present invention to provide a model display case which features an integral means for illuminating the item being displayed.

It is yet another object of the present invention to provide a model display case featuring a means for rotation of the item being displayed to enable viewing of the item from all sides without an observer having to move around the case.

Additional objects and advantages of the present invention will become apparent from the detailed description which follows, particularly when considered in conjunction with the accompanying drawing figures.

To achieve the objects of the present invention as described herein, the model display case, in accordance with preferred embodiments of the invention, comprises a model display case, which may be decorated to be simulative of a building, and which includes a rectangular base with a box-like substantially transparent, and preferably clear, plastic top. The base includes a raised support surface providing a "floor" in which an electrically powered rotating turntable is centrally positioned. The base is preferably patterned on the exterior to resemble the concrete block foundation wall of a building. The box-like top may be trimmed with chrome tape to simulate the stainless steel window frames of a building. Illumination is provided by a plurality of lights preferably mounted into the periphery of the top and camouflaged with a simulated shingled mansard roof. In the simulated ceiling of the case, the lights are screened from view from the outside by overhead partitions that also serve as reflectors to increase interior light. Screen-covered vents are preferably provided to allow for dissipation of heat produced by the lights from the interior of the case to the outside environment. The simulated floor of the case may be patterned to simulate a showroom floor such as by painting in a black-and-white checkerboard pattern. Various insignia can be added to the case to simulate a vintage automobile showroom, making the case particularly suitable for displaying model cars. Similarly, the case could be decorated as a simulated flight deck for displaying model airplanes or as a simulated roundhouse for displaying model trains.

DESCRIPTION OF THE PREFERRED EMBODIMENT

Figure 1:
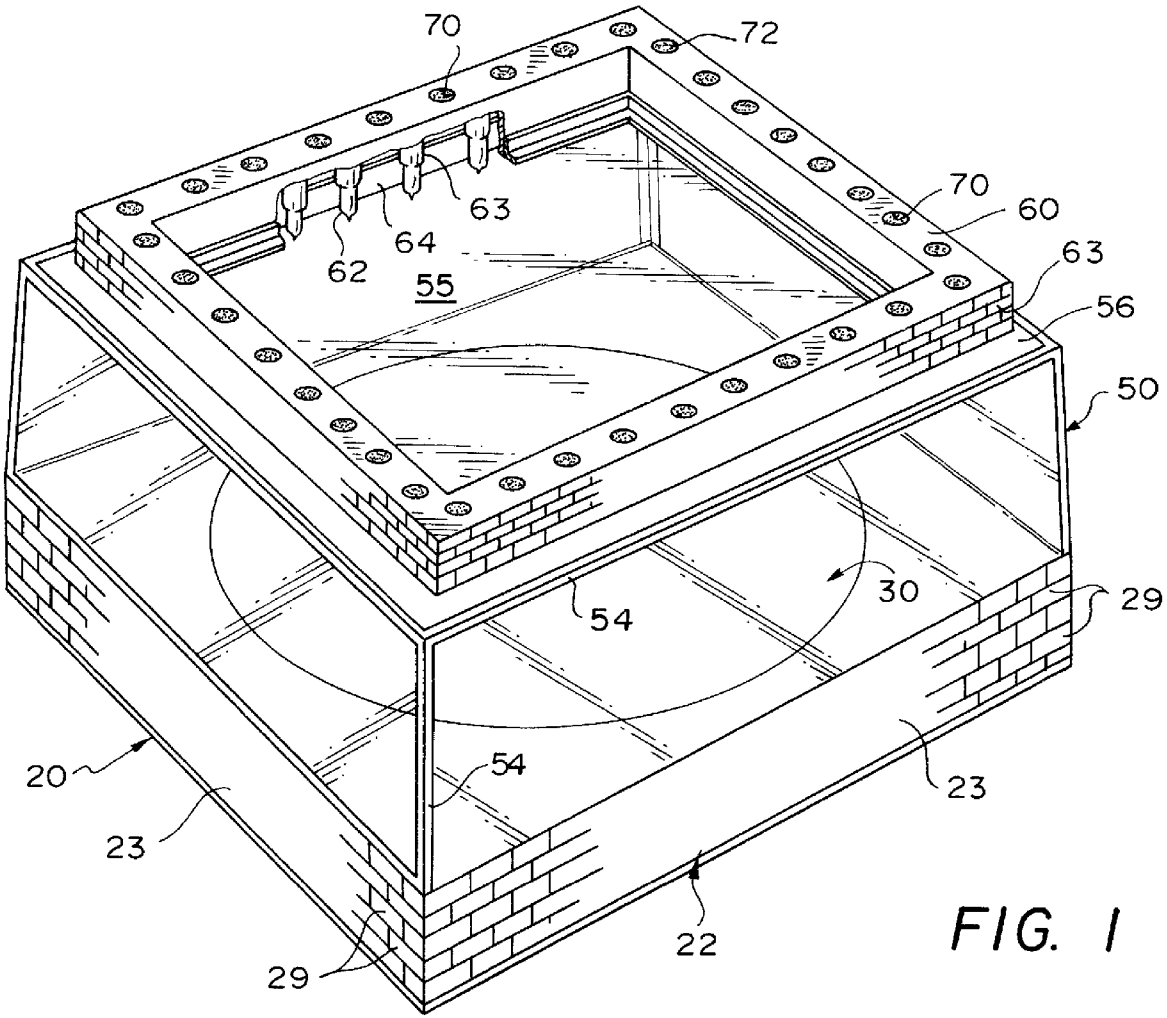
FIG. 1 is a perspective view from above of the model display case partially cut away to show the position of lights all in accordance with the present invention.
Figure 2:
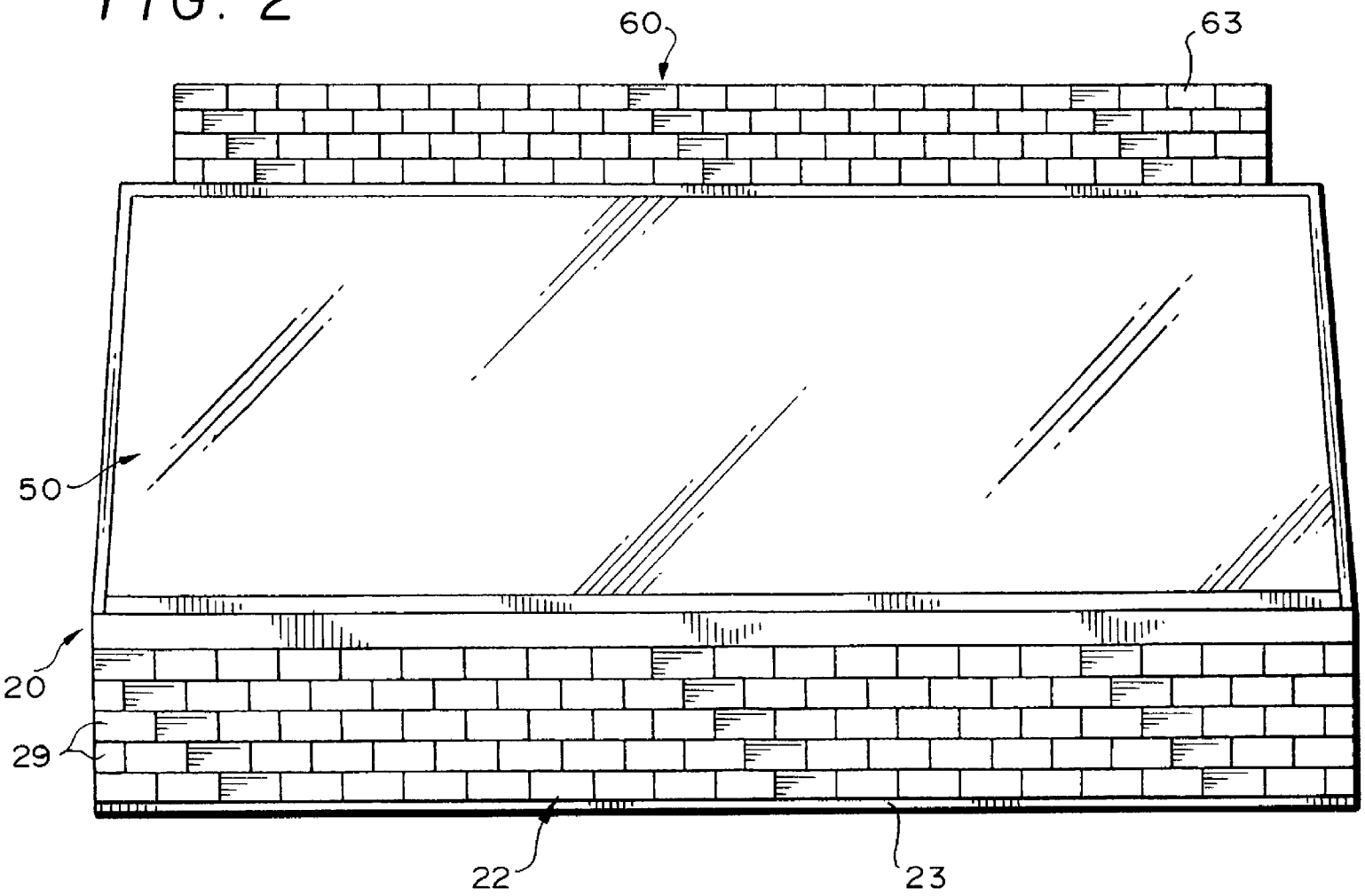
FIG. 2 is a front plan view of the model display case of FIG. 1.

With reference to FIG. 1, a preferred embodiment of a model display case in accordance with the present invention is shown by reference numeral 20 and includes a rectangular base 22, a rotating turntable 30 centrally located within the base 22, and a clear transparent cover 50, each of which is described in more detail below.

Figure 5:
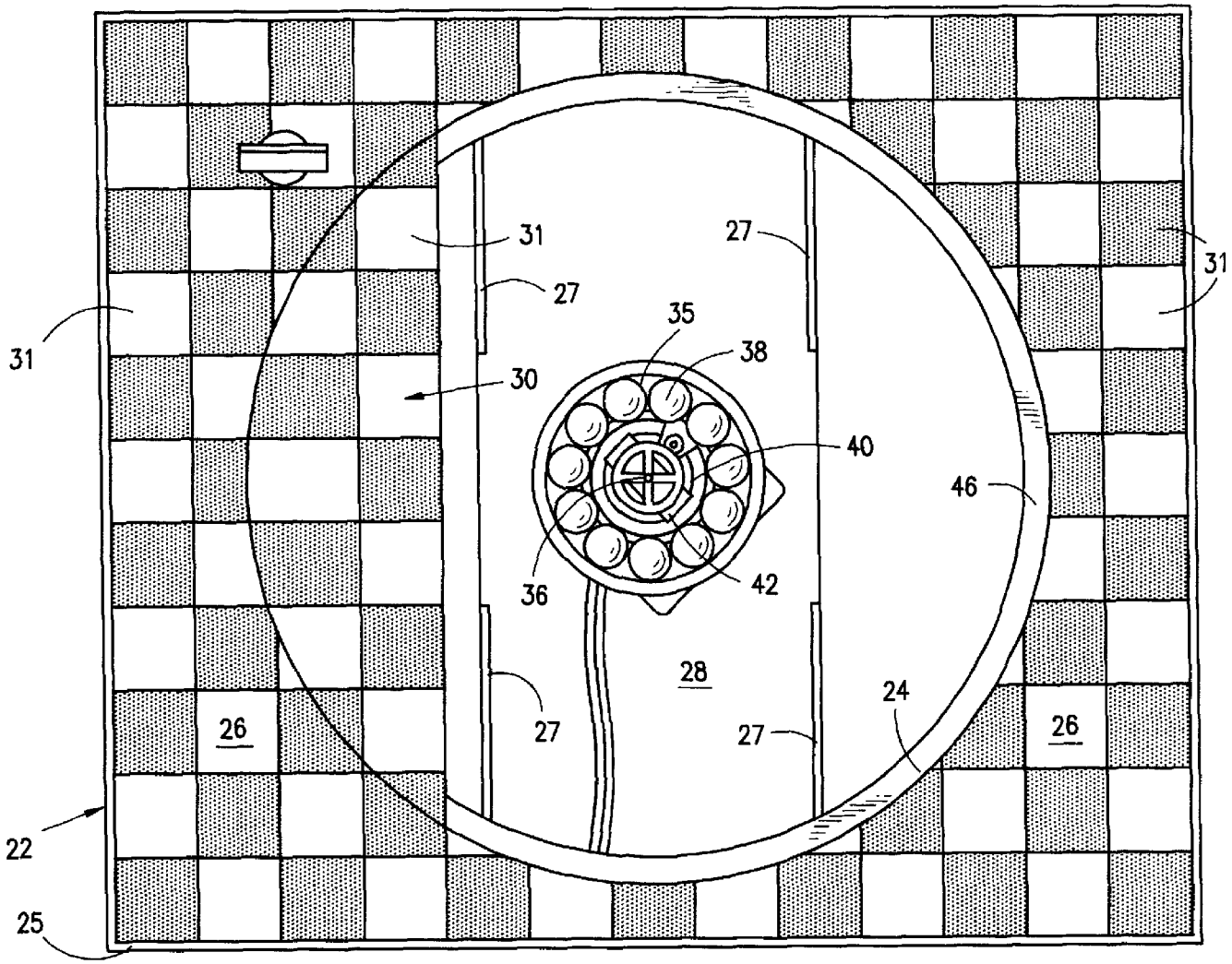
FIG. 5 is a top view of a portion of the turntable and base of the model display case partially showing a checkerboard patterned floor, all in accordance with the present invention.

The base includes side walls 23 which extend upwardly from a bottom wall to an inwardly extending ledge or shoulder 25. The base also has an upper wall 26 having a circular opening 24 therein FIG. 5, in which the turntable 30 is cooperatively aligned. The upper wall 26 and the turntable 30 combine to simulate a showroom "floor" onto which scale models or other objects may be placed for display.

Figure 3:
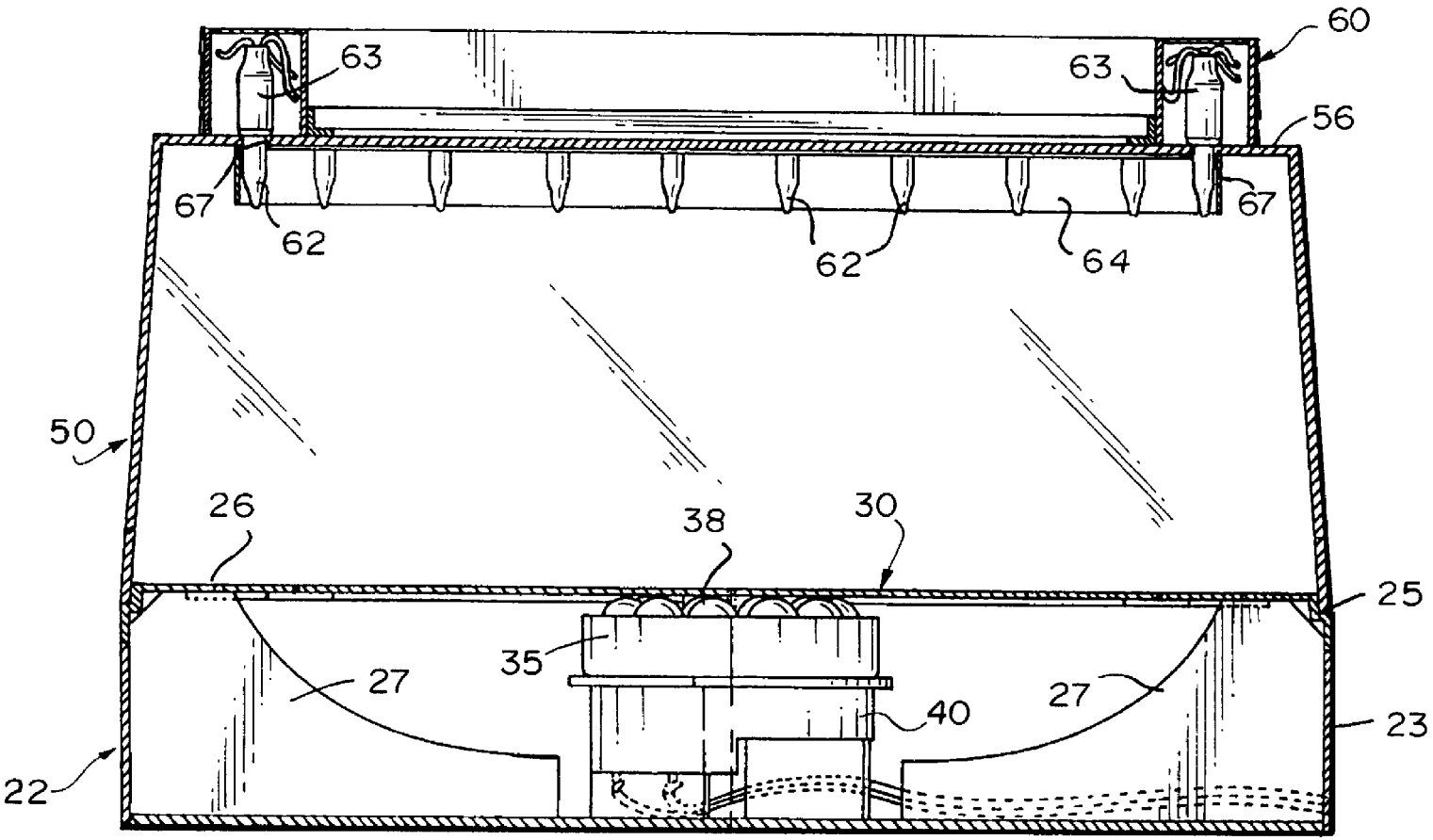
FIG. 3 is a front cross-sectional view of the model display case of FIG. 1.

The upper wall 26 is supported by a plurality of support gussets 27, as shown in FIG. 3, which are mounted within a chamber 28 defined within the base 22.

The exterior of the base 22 is preferably decorated or patterned to resemble a brick or block wall including simulated blocks 29.

Figure 4:
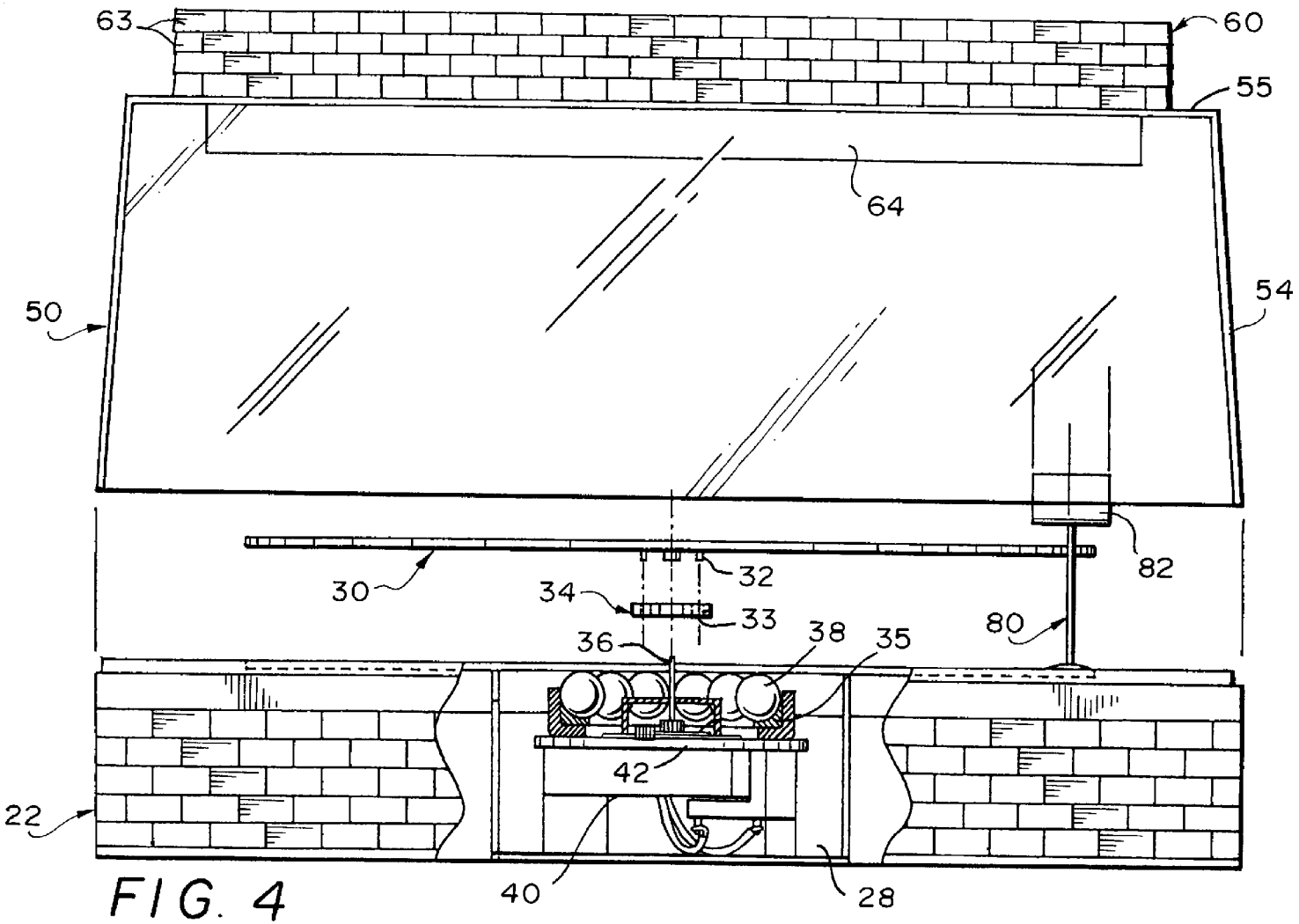
FIG. 4 is a front partially exploded, partial cross-sectional view of the model display case of FIG. 1.

Now referring particularly to FIGS. 3 and 4, the turntable 30 is positioned centrally within the base 22 to support and rotate scale models (not shown) or other objects placed thereon for display. The top of the turntable 30 is co-extensive with the upper surface 26 of the base and substantially fills the circular opening 24 therein. The surface 26 and turntable 30 combine to create a simulated floor of the case 20 which may be decorated, as in FIG. 5, with a black-and-white checkerboard pattern 31. In a particularly preferred embodiment, an approximately nine and one-half inch diameter turntable is utilized to enable the display of popular 1/24 and 1/25 scale models.

The turntable 30 may be caused to rotate using a suitable drive system. A preferred drive system includes a plurality of studs 32 which extend from the bottom of the turntable 30 and which fit within slots 33 in a drive wheel 34, which itself fits over a drive shaft 36. Preferably a plurality of ball bearings 38 support the turntable from below while allowing the turntable freedom to rotate smoothly. The ball bearings are supported in a circular track or race 35.

A motor such as a clock motor 40 (FIG. 4) drives the drive shaft 36. The gearing ratio is selected to be suitable to obtain a desired rate of rotation for the turntable 30. A drive shaft stabilizer tower 42 is preferably included to provide support and stabilization to the drive shaft 36. The motor is powered by batteries (not shown) mounted within a battery housing 48 or alternatively by conventional alternating power current. The turntable is stabilized by an annular low friction lip 46 which provides support from below to the turntable's circumference, see FIG. 5.

The cover 50 is preferably box-shaped to make it easier to cover models contained within the case. In one alternative, the could be flat and the base could include upright walls which the cover could rest on. A substantial portion of the cover 50 should be transparent to enable viewing from outside of the case. Chrome tape may be added to the exterior of the top 50 to simulate stainless steel window frames 54. The lower edge 51 of the cover seats on the ledge 25 of the base.

A generally continuous rectangular hollow and inverted U-shaped extension 60 is provided on the clear top 55 of the cover 50 and adjacent the side edges 56 thereof to contain a light source means for illuminating the interior of the display case. The illuminating means preferably includes a plurality of low wattage lights 62 which are mounted to lamp bases 63 housed within the extension 60, preferably along the entire inner periphery or length thereof. In the preferred embodiment, the lights are each three and one-half volts and extend through spaced openings 67 in the top 55 of the cover as shown in FIG. 3. Power for the lights may be supplied by batteries (not shown) or through a power cord connected to a suitable source of either AC or DC power. A generally continuous vertical light reflector 64 extends below the extension 60 and acts to obscure the lights from view from outside of the case. The reflector deflects light onto the simulated "floor" and onto the object being displayed. As shown, the exterior of the extension may be decorated to simulate a shingled mansard roof 63.

Figure 6:
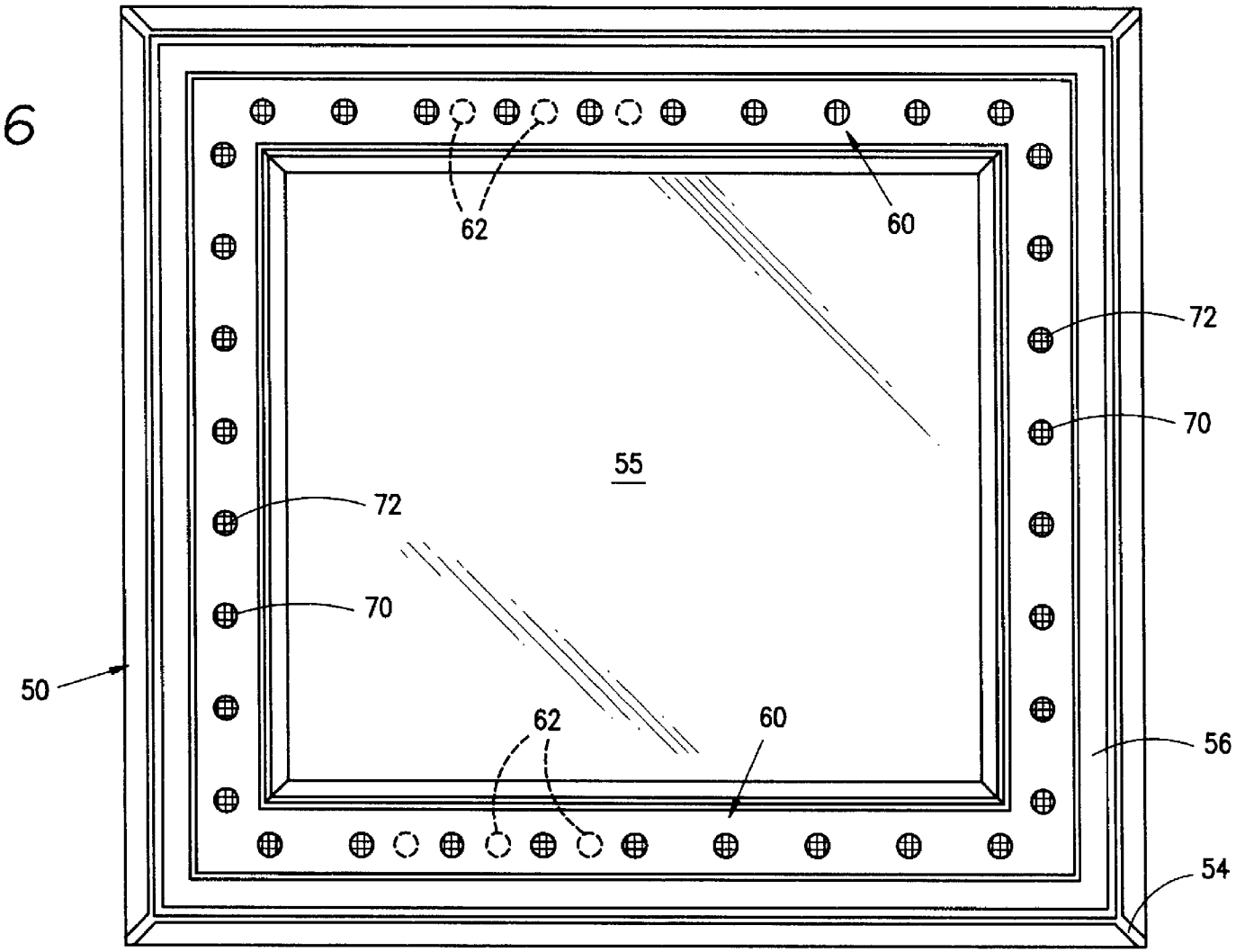
FIG. 6 is a top plan view of the model display case of FIG. 1.

As best seen in FIGS. 1 and 6, a plurality of heat vents 70 are provided in spaced relationship through an upper surface 66 of the extension 60 to ventilate heat produced by the lights 62 from within the interior of the display case to outside thereof. The vents 70 are preferably spaced intermediate each light 62 so as to be substantially adjacent thereto. The use of the vents 70 prevents the temperature of the interior of the case from exceeding approximately 80° F. Each vent opening is also preferably covered by a screen 72 to prevent dust and dirt from entering the display case.

When a model is displayed in the case 20 on the rotating turntable 30 with the lights 62 turned on, the light appears to dance on reflective surfaces of the turning model producing a very alluring effect to a viewer.

In order to provide pertinent information or statistics with respect to a model being displayed within the case, in the preferred embodiment, the case also includes a display stand 80 which may in the form of an easel in order to support a display card 82. The display stand is mounted on the upper wall 26 or "floor" of the base.

Although the display case has been described for use for displaying model cars and the like, the case can be altered to display other models, such as model trains or aircraft. In such cases, the base and cover would be simulated to form either a round house for trains or possibly a flight deck for airplanes.

The foregoing description of the preferred embodiments of the invention has been presented to illustrate the principles of the invention and not to limit the invention to a particular embodiment as illustrated. Although the invention is described with respect to preferred embodiments, modifications thereto will be apparent to those skilled in the art. It is intended that the scope of the invention be defined by all of the embodiments encompassed within the following claims and any and all equivalents thereof.

What is claimed is:

1. A model display case having an interior for displaying models comprising:

a base having an upper surface with an opening therein;

a turntable having a top surface for supporting the models being displayed, said turntable mounted within said opening in said base;

a drive means mounted in said base for rotating said turntable;

a transparent cover mounted above said base and providing a view from outside of the case of the interior of the display case and a view of displayed models therein, said cover including a generally continuous extension extending from an upper surface thereof and which defines an inverted generally U-shaped channel; and a plurality of light means mounted in spaced relationship with respect to one another within said extension for illuminating the interior of the display case and for illuminating models being displayed.

2. The model display case of claim 1 including a plurality of vent openings provided in spaced relationship through said extension, said vent openings providing for ventilation of heat from said plurality of light means mounted within said extension.

3. The model display case of claim 2 including screen means mounted at each of said vent openings in said extension for preventing particles from entering through said vent openings into the display case.

4. The model display case of claim 3 including a vent opening spaced intermediate each of said plurality of light means.

5. The model display case of claim 4 including a reflector extending from said extension inwardly of said cover for reflecting light into the display case.

6. The model display case of claim 5 in which each of said light means is of a size to be recessed relative to said extension so as to be obscured from direct view from outside the display case by said reflector.

7. The model display case of claim 6 wherein said turntable includes a top surface, said top surface being co-extensive with said upper surface of said base, and each of said upper surface of said base and said top surface of said turntable having a similar design pattern applied thereto.

8. The model display case of claim 7 in which said pattern is a checkerboard pattern.

9. The model display case of claim 7 in which said drive means for rotating said turntable includes a motor having a drive shaft, means for connecting said drive shaft to said turntable, and bearing means spaced outwardly from said drive shaft for supporting a lower surface of said turntable.

10. The model display case of claim 9 including an annular support lip mounted within said base, said annular lip being formed of a low friction material extending upwardly so as to be engageable with said turntable to provide stabilization for said turntable.

11. The model display case of claim 1 including a display stand mounted within the display case to said upper surface of said base.

12. The model display case of claim 1 in which said base has an exterior surface simulated to form a plurality of block elements and said extension has an outer surface simulated to form a tiled roof.

* * * * *